US005191906A

United States Patent [19]

Myracle, Jr.

[11] Patent Number: 5,191,906

[45] Date of Patent: Mar. 9, 1993

[54] PROCESS FOR MAKING WRAPPERS FOR SMOKING ARTICLES WHICH MODIFY THE BURN RATE OF THE SMOKING ARTICLE

[75] Inventor: James L. Myracle, Jr., Midlothian, Va.

[73] Assignee: Philip Morris Incorporated, New York, N.Y.

[21] Appl. No.: 855,491

[22] Filed: Mar. 23, 1992

Related U.S. Application Data

[63] Continuation of Ser. No. 777,466, Oct. 17, 1991, abandoned, which is a continuation of Ser. No. 605,402, Oct. 30, 1990, abandoned.

[51] Int. Cl.[5] ..... A24D 1/02

[52] U.S. Cl. ..... 131/365; 131/37; 131/69

[58] Field of Search ..... 131/365, 37, 69

[56] References Cited

U.S. PATENT DOCUMENTS

| | | | |
|---|---|---|---|
| 1,259,548 | 3/1918 | Muhlbauer . | |
| 1,393,524 | 10/1921 | Grupe . | |
| 1,393,526 | 10/1921 | Grupe . | |
| 1,476,075 | 12/1923 | Harwood . | |
| 1,555,320 | 9/1925 | Weil . | |
| 1,723,068 | 8/1929 | Parsons . | |
| 1,879,128 | 9/1932 | Desper . | |
| 1,905,416 | 4/1933 | Low . | |
| 1,996,002 | 3/1935 | Seaman . | |
| 1,999,222 | 4/1935 | Weinberger . | |
| 1,999,223 | 4/1935 | Weinberger . | |
| 1,999,224 | 4/1935 | Miles . | |
| 2,013,508 | 9/1935 | Seaman . | |
| 2,049,320 | 7/1936 | Ruben . | |
| 2,147,889 | 2/1939 | Gardiner et al. . | |
| 2,197,072 | 4/1940 | Craggs . | |
| 2,204,369 | 6/1940 | Leary . | |
| 2,329,927 | 9/1943 | Morton . | |
| 2,543,277 | 2/1951 | Copeman | 131/69 |
| 2,666,437 | 1/1954 | Lattof . | |
| 2,682,270 | 6/1954 | Schur . | |
| 2,718,889 | 9/1955 | Claussen . | |
| 2,754,828 | 7/1956 | Swain . | |
| 2,809,640 | 10/1957 | Oldenkamp . | |
| 2,866,464 | 12/1958 | Stone . | |
| 2,873,719 | 2/1959 | Schubert . | |
| 2,890,704 | 6/1959 | Lamm . | |
| 2,958,365 | 11/1960 | Molins et al. . | |
| 2,985,175 | 5/1961 | Rich . | |
| 2,990,081 | 6/1961 | De Neui et al. . | |
| 3,030,963 | 4/1962 | Cohn . | |
| 3,046,993 | 7/1962 | Rich . | |
| 3,226,282 | 12/1965 | Jackson . | |
| 3,228,402 | 1/1966 | Lebert . | |
| 3,285,253 | 11/1966 | Lebert . | |
| 3,291,136 | 12/1966 | Boyer . | |
| 3,370,593 | 2/1968 | Owaki . | |
| 3,391,699 | 7/1968 | Stericker . | |
| 3,409,021 | 11/1968 | Owaki . | |
| 3,586,005 | 6/1971 | Lippman, Jr. . | |
| 3,632,384 | 1/1972 | Saint-Pastou . | |
| 3,633,589 | 1/1972 | Kahane . | |
| 3,702,117 | 11/1972 | Borthwick . | |
| 3,835,756 | 9/1974 | Bosse . | |
| 3,903,899 | 9/1975 | Musillo . | |
| 4,044,778 | 8/1977 | Cohn . | |
| 4,077,414 | 3/1978 | Baker et al. . | |
| 4,114,629 | 9/1978 | Sedlacek et al. | 131/365 |
| 4,146,040 | 3/1979 | Cohn . | |
| 4,163,684 | 8/1979 | Kartanson . | |
| 4,187,862 | 2/1980 | Cohn . | |
| 4,230,131 | 10/1980 | Simon . | |
| 4,236,532 | 12/1980 | Schweizer . | |
| 4.303.084 | 12/1981 | Simon . | |

(List continued on next page.)

FOREIGN PATENT DOCUMENTS

| | | |
|---|---|---|
| 659839 | 6/1965 | Belgium . |
| 835684 | 3/1970 | Canada . |
| 0325921 | 8/1989 | European Pat. Off. . |
| 0407022 | 1/1991 | European Pat. Off. . |
| 1959684 | 6/1971 | Fed. Rep. of Germany . |

(List continued on next page.)

*Primary Examiner*—V. Millin
*Assistant Examiner*—Lynne A. Reichard
*Attorney, Agent, or Firm*—Fish & Neave

[57] ABSTRACT

A process for making smoking article wrappers so as to modify the mass burn rate of the smoking article.

11 Claims, 1 Drawing Sheet

U.S. PATENT DOCUMENTS

| | | | |
|---|---|---|---|
| 4,361,156 | 11/1982 | Hall | 131/37 |
| 4,407,308 | 10/1983 | Baker . | |
| 4,431,010 | 2/1984 | Seragnoli . | |
| 4,452,259 | 6/1984 | Norman . | |
| 4,453,553 | 6/1984 | Cohn . | |
| 4,461,311 | 7/1984 | Matthews . | |
| 4,480,650 | 11/1984 | Weinert . | |
| 4,489,738 | 12/1984 | Simon . | |
| 4,505,282 | 3/1985 | Cogbill . | |
| 4,527,570 | 7/1985 | Porenski et al. . | |
| 4,548,216 | 10/1985 | Ahern . | |
| 4,561,454 | 12/1985 | Guess . | |
| 4,570,650 | 2/1986 | Sirota . | |
| 4,574,821 | 3/1986 | Fischer . | |
| 4,585,016 | 4/1986 | Grollimund . | |
| 4,595,441 | 6/1986 | Holvoet et al. . | |
| 4,607,647 | 8/1986 | Dashley . | |
| 4,608,115 | 8/1986 | Schroth et al. . | |
| 4,615,345 | 10/1986 | Durocher . | |
| 4,619,278 | 10/1986 | Smeed . | |
| 4,622.983 | 11/1986 | Mathews . | |
| 4,624,268 | 11/1986 | Baker . | |
| 4,642,085 | 2/1987 | Helm . | |
| 4,666,550 | 5/1987 | Spiers et al. . | |
| 4,679,574 | 7/1987 | Lang . | |
| 4,679,575 | 7/1987 | Yamaguchi . | |
| 4,691,717 | 9/1987 | Ikeda . | |
| 4,721,120 | 1/1988 | Greig . | |
| 4,730,628 | 3/1988 | Townsend . | |
| 4,739,775 | 4/1988 | Hampl, Jr. . | |
| 4,779,631 | 10/1988 | Durocher . | |
| 4,781,203 | 11/1988 | LaHue . | |
| 4,784,164 | 11/1988 | Adams . | |
| 4,795,510 | 1/1989 | Wittrock et al. . | |
| 4,825,883 | 5/1989 | Hinz et al. . | |
| 4,825,885 | 5/1989 | Kounnas . | |
| 4,832,057 | 5/1989 | Bale et al. | 131/365 |
| 4,841,993 | 6/1989 | Hinz et al. . | |
| 4,902,375 | 2/1990 | Holmes et al. . | |
| 4,909,885 | 3/1990 | Swenson . | |
| 4,928,715 | 5/1990 | Mentzel . | |
| 4,942,888 | 7/1990 | Montoya . | |
| 4,942,889 | 7/1990 | Grollimund . | |
| 4,945,932 | 8/1990 | Mentzel . | |
| 4,984,589 | 1/1991 | Riedesser . | |
| 4,987,940 | 1/1991 | Straub et al. . | |

FOREIGN PATENT DOCUMENTS

| | | |
|---|---|---|
| 1040981 | 10/1953 | France . |
| 1131423 | 2/1957 | France . |
| 1517262 | 3/1968 | France . |
| 1590223 | 5/1970 | France . |
| 2044336 | 2/1971 | France . |
| 2177138 | 2/1973 | France . |
| 58-170469 | 7/1983 | Japan . |
| 60-164472 | 8/1985 | Japan . |
| 62-257377 | 11/1987 | Japan . |
| 63-169979 | 7/1988 | Japan . |
| 63224486 | 3/1990 | Japan . |
| 90/14776 | 12/1990 | PCT Int'l Appl. . |
| 89816 | 7/1921 | Switzerland . |
| 142429 | 9/1930 | Switzerland . |
| 615090 | 1/1980 | Switzerland . |
| 22161 | of 1902 | United Kingdom . |
| 421236 | 12/1934 | United Kingdom . |
| 1047015 | 11/1962 | United Kingdom . |
| 1056941 | 2/1967 | United Kingdom . |
| 1235692 | 6/1971 | United Kingdom . |
| 2020535 | 11/1979 | United Kingdom . |

PROCESS FOR MAKING WRAPPERS FOR SMOKING ARTICLES WHICH MODIFY THE BURN RATE OF THE SMOKING ARTICLE

BACKGROUND OF THE INVENTION

The present invention generally relates to a process for making wrappers for smoking articles such as cigarettes, and more specifically to a process for making cigarette wrappers which modify the mass burn rate of the cigarette.

It is beneficial to make cigarettes in commercial quantities which will have a reduced burn rate if not drawn on by the smoker but which will look, feel, taste and burn like a conventional cigarette when being drawn on by the smoker at normal intervals. It is recognized by those skilled in the art that the wrapper construction of the cigarette strongly, influences these characteristics.

Cigarettes made to have a reduced burn rate through a modification of the wrapper have been described previously. For example, Weinert U.S. Pat. No. 4,489,650 describes a cigarette in which the interior surface of the wrapper is coated with clay. In Cohn U.S. Pat. No. 4,044,778, the cigarette wrapper includes rings or areas coated with an alkali silicate which renders the wrapper non-burning in the coated areas.

Durocher U.S. Pat. No. 4,615,345 describes a wrapper made of a cellulose fiber base which normally does not sustain burning when the wrapper is incorporated into a cigarette. The wrapper is treated in selected zones with an alkali metal burn promoter such as the potassium salt of citric acid. It is described that a cigarette made with a wrapper so treated will smolder without being drawn on by the smoker when in the treated zone but when the treated zone is consumed will extinguish itself unless the cigarette is drawn on by the smoker. Cigarette wrappers of the character described in Durocher have not been found to produce cigarettes which look, feel, taste and burn like a conventional cigarette.

Hampl U.S. Pat. No. 4,739,775 also describes a cigarette wrapper which will sustain burning only if drawn on by the smoker at normal intervals. Bands of a cellulose fiber base web which will not sustain burn are added to a conventional cigarette wrapper. The bands are selected and positioned to create a cigarette with the desired burning characteristics. While cigarette wrappers of the character described in Hampl have been found to exhibit the desired look, feel, taste and burn qualities, there was no known process for making such cigarette wrappers in commercial quantities.

Accordingly, it is the object of the present invention to provide a process for making wrappers in commercial quantities which produce cigarettes which will have a reduced burn rate if not drawn on by the smoker but which look, feel, taste and burn like a conventional cigarette when being drawn on by the smoker at normal intervals.

Another object of this invention is to provide a process for making wrappers in commercial quantities which produce cigarettes which exhibit the burning characteristics described in Hampl U.S. Pat. No. 4,739,775 or Durocher U.S. Pat. No. 4,615,345.

A further object of this invention is to provide a process for making wrappers which modify the mass burn rate of the cigarette by applying circumscribing bands of paper of specified width at intervals along the longitudinal axis of a cigarette wrapper. Both the bands of paper and the cigarette wrapper may be selected from conventional materials or specially selected or chemically treated materials so as to provide a cigarette with the desired mass burn rate.

SUMMARY OF THE INVENTION

The foregoing objects are achieved by selecting paper which will be applied in bands (hereinafter "band paper") to a surface of a moving continuous web of smoking article wrapper. Adhesive is applied to a surface of a continuous web of moving band paper and the continuous web of band paper is cut into segments having a desired length, measured in a direction parallel to the direction of travel of the web of band paper.

The band paper is cut along an axis perpendicular to the direction of travel of the web of band paper and the segments of band paper are spaced a first distance apart from one another. The segments of band paper are then adhered to a surface of a continuous web of moving smoking article wrapper, said segments being spaced a second distance apart from one another which may be equal to or different from the first distance apart. The web of smoking article wrapper may then be wrapped around a tobacco plug to form cigarettes in the manner known to those skilled in the cigarette making art.

BRIEF DESCRIPTION OF THE DRAWINGS

The objects and features of the present invention are shown in the following detailed description of the invention, taken in conjunction with the accompanying figures, in which like reference characters refer to like elements throughout, and in which.

DETAILED DESCRIPTION OF THE INVENTION

Figure 1:
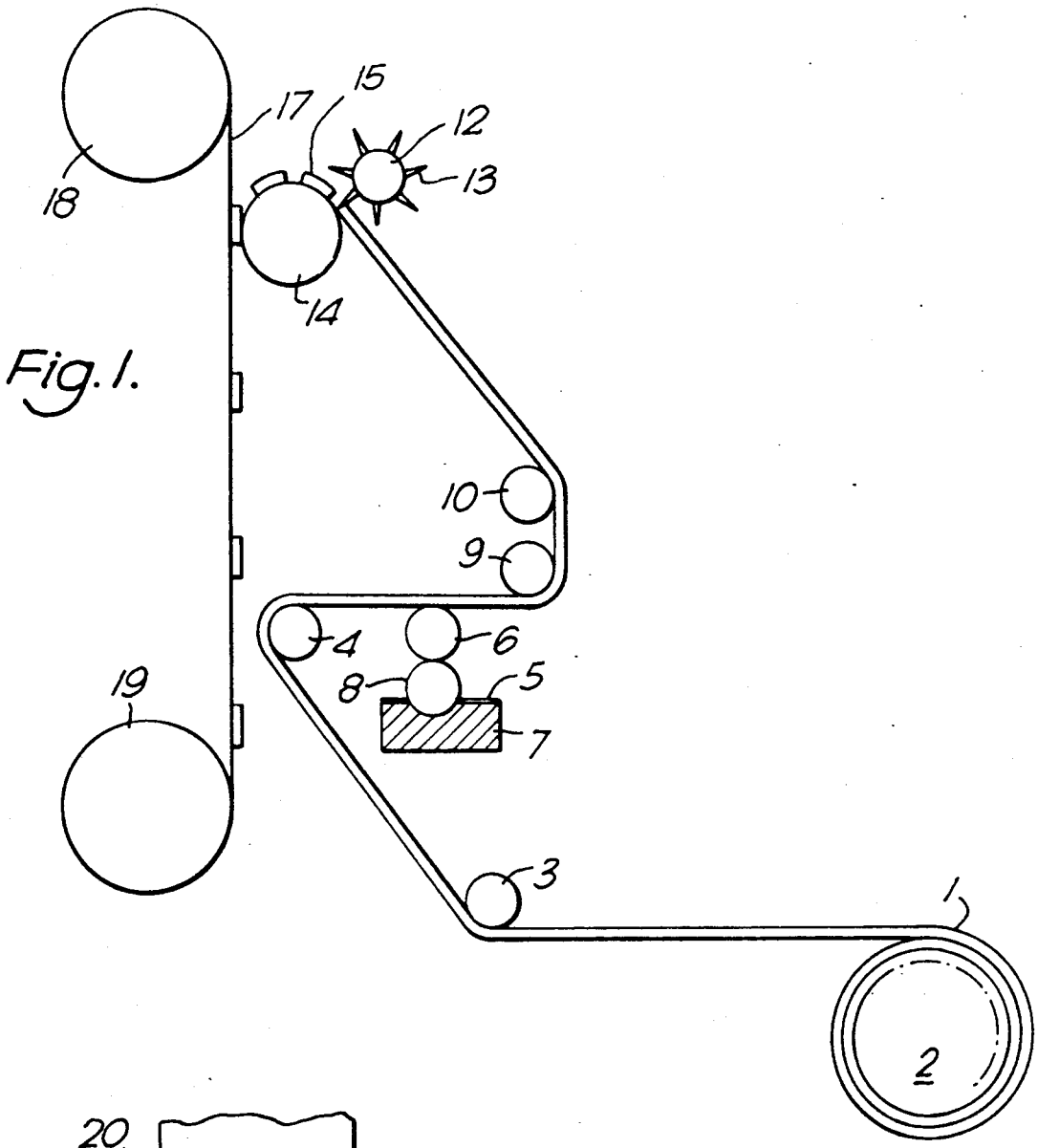
FIG. 1 is a schematic drawing of apparatus for carrying out the process of the invention.

Referring to FIG. 1, an apparatus for carrying out the process of this invention draws a continuous web of band paper 1 from band paper supply roll 2. The band paper may be selected from any of the common varieties of cigarette wrappers known in the art or the band paper may be specially selected or treated with compounds known in the art to control the burning of the band paper. In a preferred embodiment, band paper 1 is selected to exhibit inhibited burn characteristics as described in Hampl U.S. Pat. No. 4,739,775. In another preferred embodiment, the band paper contains flax or other cellulose fibers and is treated with an elevated amount of alkali metal burn regulator, for example, carboxylic acid salts of sodium and, especially potassium, in an amount sufficient to allow a cigarette made with such band paper to free-burn continuously as described in Durocher U.S. Pat. No. 4,615,345.

Figure 2:
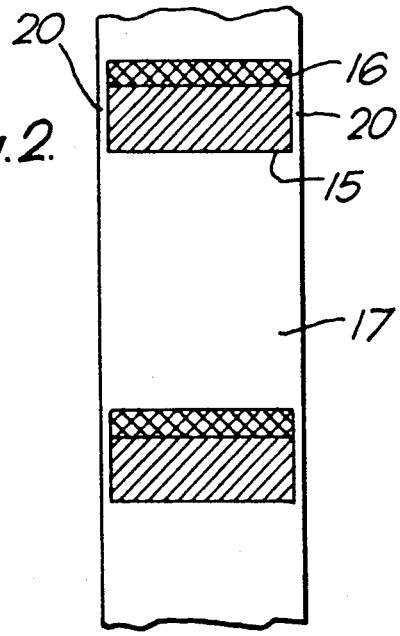
FIG. 2 is an enlarged view of a surface of a portion of the web of cigarette wrapper after it has been acted upon by apparatus for carrying out the process of the invention.

Band paper 1 is drawn around roller 3 and roller 4 such that a surface of the continuous web of band paper is brought into contact with roller 6 of adhesive applicator 5. In a preferred embodiment, adhesive applicator 5 takes up a liquid adhesive such as those adhesives known in the cigarette making art from adhesive tank 7 onto roller 8 which transfers the adhesive to roller 6. In a more preferred embodiment, roller 6 is constructed to apply strips of adhesive 16 (FIG. 2) to the web of band paper 1. Such strips being applied in a direction perpendicular to the direction of travel of the web of band paper and having a length, measured in a direction orthogonal to said strip of adhesive, less than the length of a segment of band paper. After application of the adhesive, the web of band paper is drawn around rollers 9, 10.

From roller 10, the web of band paper is drawn around roller 14. Roller 14 is positioned in relation to roller 12 such that each of a plurality of cutting blades 13 which are affixed to roller 12 will cut the band paper into segments 15 along an axis perpendicular to the direction of travel of the web of band paper as it rotates into contact with roller 14. In a preferred embodiment, roller 14 is a vacuum roller such that the vacuum force will hold segment 15 on roller 14 as segment 15 is rotated into contact with web of cigarette wrapper paper 17. Also in a preferred embodiment, the rotational speeds of rollers 14 and 12 are adjusted such that each cutting blade 13 both cuts the web of band paper 1 into segments 15 and spaces the segments a first distance apart from one another. Preferably band paper 1 is cut into segments 15 which are approximately 5 mm in length as measured along an axis parallel to the direction of travel of web of band paper 1.

A continuous web of cigarette wrapper paper 17 is drawn from supply roller 18 and onto take-up roller 19. The web of cigarette wrapper 17 may be selected from any of the common varieties of cigarette wrappers known in the art or may be specially selected or treated with compounds known in the art to control the burning of the web of cigarette wrapper 17. Preferably, web of cigarette wrapper 17 will be selected to cooperate with band paper % to yield a cigarette with the desired burn rate. In a preferred embodiment, cigarette wrapper 17 may be conventional cigarette paper with a fiber component of flax or other cellulosic fiber as referred to in Hampl U.S. Pat. No. 4,739,775. In another preferred embodiment, the web of cigarette wrapper paper 17 contains flax or other cellulose fibers and is made such that cigarettes using it will have a reduced burn rate in a standard free-burn mode as described in Durocher U.S. Pat. No. 4,615,345.

Supply roller 18 and take-up roller 19 are oriented such that segments of band paper 15 on roller 14 are placed against and adhesively adhered to web of cigarette wrapper paper 17. In a preferred embodiment, segment of band paper 15 is oriented such that adhesive strip 16 (FIG. 2) is perpendicular to the direction of travel of web of cigarette wrapper paper 17. Preferably, the band paper 1 is selected to be slightly narrower than the web of cigarette wrapper paper 17 such that when the segment of band paper 15 is positioned on the web of cigarette wrapper paper 17 along the axis perpendicular to its direction of travel there is a sufficient margin 20 (FIG. 2) to allow the wrapper to be rolled around a tobacco plug and glued in the manner known to those in the cigarette making art without any overlapping of segment of band paper 15. This is exemplified in FIG. 2, which shows band paper 15 centered on the web of cigarette paper 17. Such centering is not, however, necessary. Also preferably, the rate of travel of the wrapper paper 17 from supply roller 18 to take-up roller 19 is selected to be related to the speed of roller 14 such that a segment of band paper 15 may be adhered to wrapper paper 17 at intervals of from 5 mm. to 20 mm.

Thus, the wrapper and smoking article made according to the process of this invention will have a modified burn rate such that the smoking article will have a reduced burn rate if not drawn on by the smoker but will burn in the same manner as a conventional cigarette when drawn on by the smoker in the normal way. One skilled in the art will appreciate that the present invention can be practiced by other than the described embodiments, which are presented for purposes of illustration and not of limitation, and the present invention is limited only by the claims which follow.

I claim:

1. A process for modifying the burn rate of a smoking article by applying segments of band paper to the wrapper of a smoking article comprising:

applying adhesive to a surface of a continuous web of moving band paper, said band paper having been selected to modify the burn rate of a smoking article when adhered to the wrapper of said smoking article;

cutting the continuous web of band paper into segments having specified length, said cutting occurring along an axis perpendicular to the direction of travel of the web of band paper;

spacing the segments of band paper a first distance apart from one another;

adhering the segments of band paper to a surface of a continuous web of moving smoking article wrapper, said segments being spaced a second distance apart from one another.

2. The process of claim 1 wherein the first distance apart is equal to the second distance apart.

3. The process of claim 1 wherein the first distance apart is different from the second distance apart.

4. The process of claim 1 wherein the adhesive is applied in a strip perpendicular to the direction of travel of the web of band paper and said strip of adhesive having a length, measured in a direction orthogonal to said strip of adhesive, less than the length of the segment of band paper.

5. The process of claim 4 wherein the length of the segments of band paper are approximately 5 mm.

6. The process of claim 5 wherein the segments of band paper are adhered to the continuous web of moving smoking article wrapper with a second distance of spacing between 5 and 20 mm.

7. The process of claim 6 wherein the band paper has a width, measured along an axis perpendicular to the direction of travel of said band paper, which is more narrow than the width of the web of smoking article wrapper such that said wrapper can be formed around a tobacco plug to form a cigarette without overlap of the band paper segment.

8. The process of claim 7 wherein the continuous web of moving band paper contains flax or cellulose fiber material treated with an alkali metal salt to act as a burn regulator.

9. The process of claim 8 wherein the web of smoking article wrapper contains flax or cellulose fiber material such that smoking articles made from such wrapper will have a reduced burn rate if not drawn on by the smoker.

10. The process of claim 7 wherein the continuous web of moving band paper has reduced burn characteristics.

11. The process of claim 10 wherein the smoking article wrapper is made of conventional cigarette wrapper material.

* * * * *